US008641960B1

(12) United States Patent
Medeiros et al.

(10) Patent No.: US 8,641,960 B1
(45) Date of Patent: Feb. 4, 2014

(54) SOLUTION BLOW SPINNING

(75) Inventors: Eliton S. Medeiros, Joao Pessoa PB (BR); Gregory M. Glenn, American Canyon, CA (US); Artur P. Klamczynski, Orinda, CA (US); William J. Orts, Burlingame, CA (US); Luiz H. C. Mattoso, Sao Carlos SP (BR)

(73) Assignee: The United States of America, as represented by the Secretary of Agriculture, Washington, DC (US)

( * ) Notice: Subject to any disclaimer, the term of this patent is extended or adjusted under 35 U.S.C. 154(b) by 251 days.

(21) Appl. No.: 12/893,313

(22) Filed: Sep. 29, 2010

Related U.S. Application Data

(60) Provisional application No. 61/246,909, filed on Sep. 29, 2009.

(51) Int. Cl.

| | |
|---|---|
| ***D01D 5/098*** | (2006.01) |
| ***D01D 7/00*** | (2006.01) |
| ***D04H 3/02*** | (2006.01) |

(52) U.S. Cl.
USPC ..... 264/555; 264/85; 264/103; 264/210.8; 264/211.14

(58) Field of Classification Search
USPC ..... 264/85, 103, 205, 210.8, 211.14, 555
See application file for complete search history.

(56) References Cited

U.S. PATENT DOCUMENTS

| | | | | |
|---|---|---|---|---|
| 3,920,362 | A * | 11/1975 | Bradt | 425/72.2 |
| 2002/0060382 | A1* | 5/2002 | Luo et al. | 264/555 |
| 2003/0137069 | A1* | 7/2003 | Reneker | 264/555 X |
| 2005/0056956 | A1* | 3/2005 | Zhao et al. | 264/555 X |
| 2005/0073075 | A1* | 4/2005 | Chu et al. | 264/465 |
| 2007/0112115 | A1* | 5/2007 | Shalaby et al. | 524/431 |

* cited by examiner

*Primary Examiner* — Leo B Tentoni
(74) *Attorney, Agent, or Firm* — Howard V. Owens, Jr.; John D. Fado; Lesley Shaw

(57) ABSTRACT

The present invention relates to a solution blow spinning method for the production of nonwoven webs of micro and nanofibers.

10 Claims, 8 Drawing Sheets

SOLUTION BLOW SPINNING

RELATED APPLICATIONS

This application is claims priority to U.S. Provisional Patent Application Ser. No. 61/246,909, filed Sep. 29, 2009, the contents of which are incorporated herein by reference in their entirety.

FIELD OF THE INVENTION

The present invention relates to a solution blow spinning method for the production of nonwoven webs of micro and nanofibers.

SUMMARY OF THE INVENTION

Currently, most nonwoven micro or nanofiber webs are produced by melt spinning, electrospinning, or by melt blowing. The melt spinning process involves drawing down extruded strands of melted polymer to reduce the fiber diameter and induce orientation of the polymer chains. One of the limitations of melt spun fiber technology is that it is restricted to viscoelastic materials that can withstand the stresses developed during the drawing process. The diameter of fibers made by this process is typically greater than 2 μm. A variation of melt spinning that produces nanofibers is the islands-in-the-sea process where several individual strands of one polymer component are produced within a larger single strand of a second polymer component. Even though electrospinning is considered the technique with the most potential for scaling to commercial production of nanofibers, low fiber production efficiency is still considered its greatest limitation. Furthermore, the solvents that are compatible with the electrospinning process may be limited by their dielectric constant. Melt blowing is another method for making nonwoven webs that has proven to be scalable for commercial production. It involves extruding molten polymer through a narrow orifice and into a stream of high velocity hot air. The drag of the hot air on the surface of the polymer melt causes the polymer, under optimal conditions, to elongate into a fiber. The process can be controlled to produce fibers ranging in diameters from 1 to 50 micrometers. While traditional melt blowing is an efficient and economical process for commercial production of nonwoven fiber products, it cannot produce fibers with diameters in the same size range as electrospun fibers and it is limited to thermoplastic polymers.

Therefore, it is one object of the present invention to provide a method and apparatus for the production of micro and nanofibers via formation of solution cones from an adjustable concentric nozzle, with fiber diameters similar to those produced by electrospinning. Another object of the invention is to provide fibers which have multiple components in both the sheath and core of the fiber. Another object of the invention is the production of nonwoven webs of micro and nanofibers.

A further object of the invention is the use of the fibers produced by the aforementioned method in medical and non-medical applications.

DESCRIPTION OF THE INVENTION

The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Accordingly, unless otherwise indicated, the numerical properties set forth in the following specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurement.

DEFINITIONS

"Fiber" refers to a polymer in the form of continuous or discontinuous filaments whose aspect ratio, length/diameter, is greater than 1000.

"Nanofiber" refers to a polymeric fiber whose diameter less than or equal to 100 nm and has an aspect ratio (length/diameter) greater than 1000.

"Solid core" fiber refers to a non-porous fiber comprised of polymer or polymer blend.

"Porous" fiber refers to a fiber with voids interspersed through out the fiber matrix.

"Core/sheath" fiber refers to a solid core comprised of one polymer or polymer blend and an outer coating or sheath comprised of a polymer or polymer blend different and distinct from the core material.

"Hollow" fiber refers to a sheath component with no core material present.

"Solution spinning" or "air spinning" refers to an alternative method for making nonwoven webs of micro and nanofibers via delivery of a polymer solution to an apparatus consisting of concentric nozzles whereby the polymer solution is pumped through the inner nozzle while a constant, high velocity gas flow is sustained through the outer nozzle.

"Solution Cone" refers to a cone-shaped formation that develops at the tip of the nozzle component through which the polymer solution is pumped. The shearing effect of the pressurized gas impinging upon the inner nozzle tip forces the polymer solution into a cone shape. The formation of a solution cone is critical in the production of nanofibers at the tip of the cone.

"Blowing medium" refers to any source of air or gas which provides a force effective enough for formation of the nanofibers.

Figure 1:
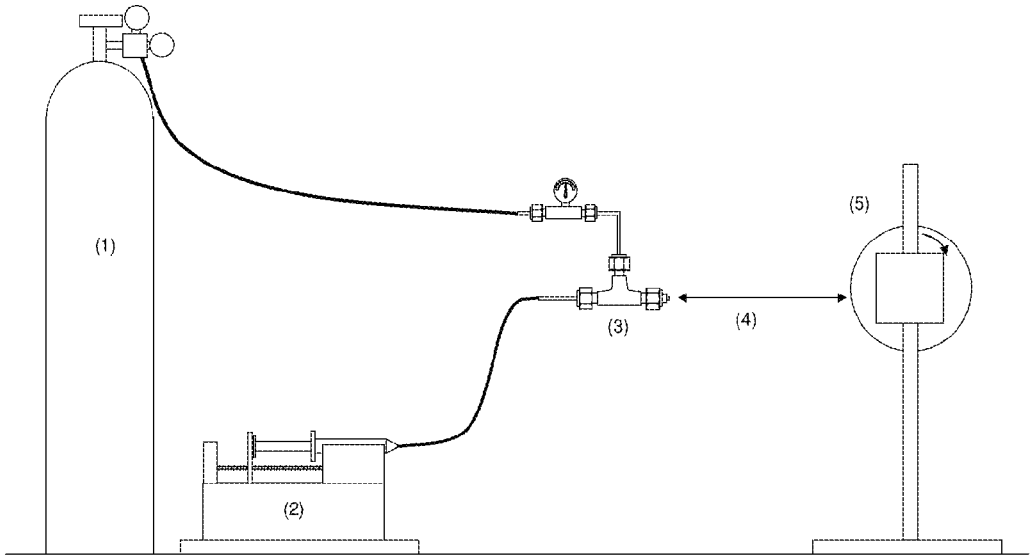
FIG. 1 is a diagram of a solution-spinning setup: (1) blowing medium; (2) injection pump with syringe; (3) nozzle and pressure gauge; (4) working distance and (5) rotating collector.
Figure 2:
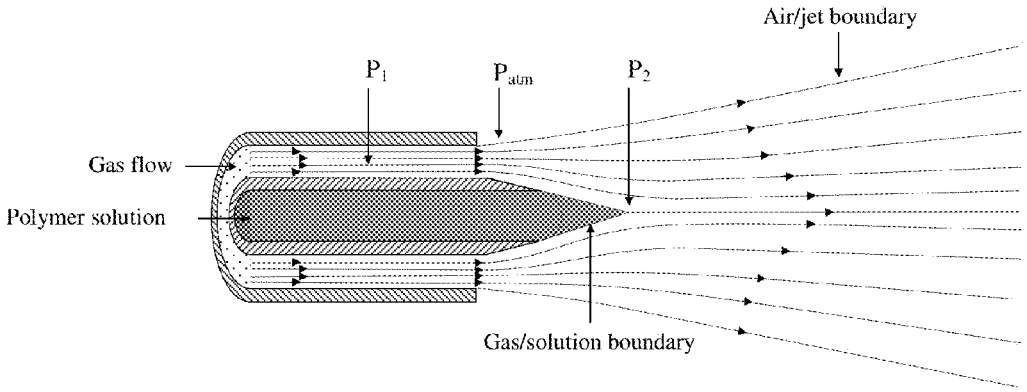
FIG. 2 is a diagram of a nozzle design used in solution blow spinning of polymer solutions. The complete nozzle consisted of an inner nozzle component through which polymer solution is pumped and an outer nozzle component through which a high pressure ($P_1$) stream of air passes. The nozzle geometry creates a region of low pressure around the inner nozzle ($P_2$) which helps draw the polymer solution into a solution cone.

Herein is described a method and apparatus for the production of micro and nanofibers via formation of solution cones, with fiber diameters similar to those produced by electro spinning. The air spinning apparatus used consists of a nozzle through which a polymer solution is injected into a stream of accelerated air. The blowing medium is provided by a source of compressed gas, such as nitrogen, oxygen, argon and air, equipped with a pressure regulator, a device to hold the polymeric fluid for injection into the nozzle design, a pump to control the injection rate (β) of the polymer solutions, a spraying nozzle that consists of concentric nozzle components, and a collector with a controllable rotation speed (FIG. 1). The collector is positioned at a fixed working distance from the spraying nozzle. The spraying nozzle consists of an inner nozzle component through which a polymer solution is pumped and an outer nozzle component through which a high pressure (P1) stream of air passes. The nozzle geometry creates a region of low pressure around the inner nozzle component (P2) which helps draw the polymer solution into a solution cone (FIG. 2). An embodiment of the nozzle design is the ability to adjust how far the inner nozzle component protrudes beyond the planar face of the outer nozzle. The inner nozzle may be adjusted to protrude 0.1 to 10 times the diameter of the outer nozzle. A further embodiment of the nozzle design is the use of multiple concentric nozzle components to produce core/sheath structures. In the case of a three concentric nozzle component design, a polymer solution is injected through the inner nozzle component forming a core, a second polymer solution is injected through the intermediary nozzle component which forms the sheath, and a gas is injected through the outermost nozzle component such that micro and nanofibers consisting of core/sheath structure is produced. The same three concentric nozzle component design can be use to form hollow micro and nanofibers by injecting air through the inner nozzle component, injecting polymer solution through the intermediary nozzle component, and injecting a gas through the outermost nozzle component.

Each concentric nozzle component that carries pressurized air makes use of Bernoulli's principle in which changes in pressure are converted into kinetic energy, i.e., as the high pressure gas stream (FIG. 2, $P_1$) exits the outer nozzle component, the pressure quickly drops (FIG. 2, $P_{atm}$) increasing the kinetic energy of the stream and resulting in an increase in the velocity of the gas. In the nozzle design of the invention, the angle of the outlet of the outer nozzle is zero, parallel to the inner nozzle, with straight walls that induce laminar flow, wherein the inner nozzle is tapered to facilitate gas flow towards the liquid and formation of the solution cone.

This increase in air velocity promotes a drop in air pressure at the center of the jet ($P_2$), creating a driving force that is responsible for acceleration of the polymer solution. The high velocity gas also induces shearing at the gas/solution interface that is responsible for deforming the polymer solution exiting the inner nozzle component into a conical shape. When the surface tension is overcome by these forces fine streams of polymer solution are jettisoned toward the collector or target area. While in flight, solvent rapidly evaporates from these streams forming polymer fibers which accumulate on the collector or target area.

Figure 3:
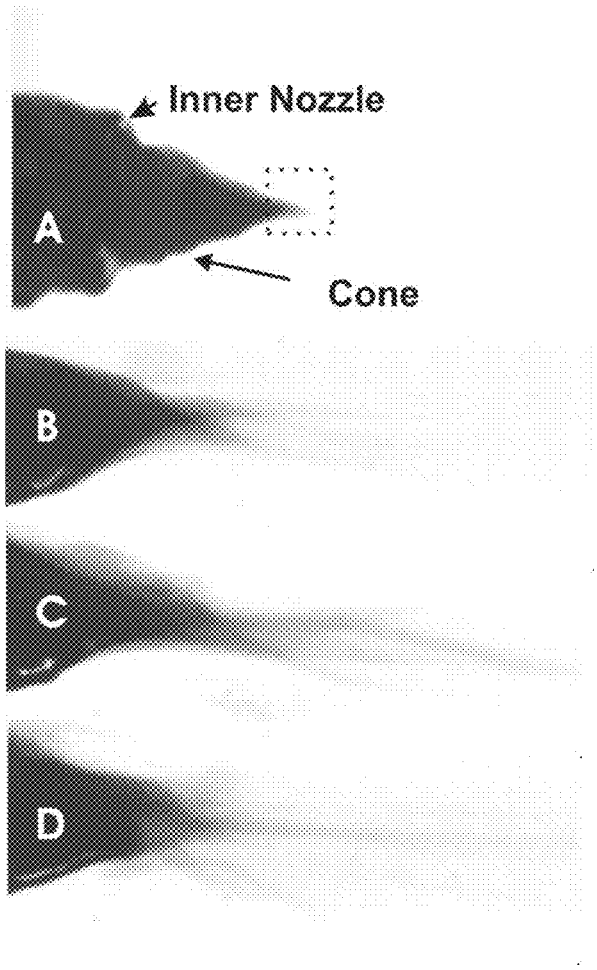
FIG. 3 is microphotographs of solution spun fibers taken by a high speed camera. The low pressure region at the end of the inner nozzle formed the polymer solution into a solution cone (A). The region enclosed by dashed lines was magnified and shown in B-D. Jets of polymer solution formed near the cone tip can be seen streaming toward the collector (B-D).

When there is no air flowing through the outer nozzle component, a convex droplet of polymer solution typically was formed at the inner nozzle component as illustrated in FIG. 2 (dashed line). As air flow to the outer nozzle component is initiated, a region of low pressure develops near the orifice of the inner nozzle component (FIG. 2, $P_2$). The low pressure zone could be further verified by disengaging the injection pump and observing that polymer solution could be drawn through the inner nozzle component by simply providing gas-flow to the outer nozzle component. The convex droplet of polymer solution was drawn into a cone shape as air flow increased through the outer nozzle component (FIG. 2, 4A). Photomicrographs revealed that strands of polymer solution were jettisoned from the apical region of the cone towards the collector. The strands were consistently jettisoned to the collector due to the combination of the low pressure zone and shearing at the solution/gas interface (FIG. 3B-D). As with the electro spinning process, the high surface to volume ratio of the strands coupled with the high air turbulence caused the solvent component to evaporate by the time the strand reached the collector.

Another object of the invention is to provide fibers which have multiple components in both the sheath and core of the fiber. Multiple components in the sheath and/or core of the fiber are achieved by using a mixture of solubilized polymers. A reservoir with the ability to deliver at least one solubilized polymer (at a controlled rate) is used to feed the polymeric solution to the nozzle.

Any solvent can be used that allows delivery of the material or substance through the nozzle and that is sufficiently volatile as to evaporate before the jettisoned fiber reaches the collector. The solvent may be used for dissolving or suspending the material or the substance to be blow spun. Solvents useful for dissolving or suspending a material or a substance depend on the material or substance and may be referenced by CRC Handbook of Chemistry and Physics incorporated by reference as if set forth fully herein.

Synthetic polymers of the invention include biodegradable and non-biodegradable polymers. Such polymers include but are not limited to the following: polyaniline (PAni), polystyrene (PS), poly(lactic acid) (PLA), polyurethanes, polysiloxanes or silicones, polyethylene and oxides thereof, poly(vinyl pyrrolidone), polycaprolactones, poly(2-hydroxy ethyl methacrylate), poly(N-vinyl pyrrolidone), poly(methyl methacrylate)-PMMA, poly(vinyl alcohol), poly(acrylic acid), polyacrylamide, polyacrylonitrile, poly(ethylene terphthalate), poly(ethylene-co-vinyl acetate), poly(ethylene glycol), poly (methacrylic acid), polylactides (PLA), polyglycolides (PGA), poly(lactide-co-glycolid-es) (PLGA), polyanhydrides, and polyorthoesters or any other similar synthetic polymers that may be developed that are biologically compatible. The term "biologically compatible, synthetic polymers" shall also include copolymers and blends, and any other combinations of the forgoing either together or with other polymers generally. The use of these polymers will depend on given applications and specifications required. A more detailed discussion of these polymers and types of polymers is set forth in Brannon-Peppas, Lisa, "Polymers in Controlled Drug Delivery," Medical Plastics and Biomaterials, November 1997, which is incorporated by reference as if set forth fully herein.

Examples of natural polymers of the invention include, but are not limited, to amino acids, peptides, denatured peptides such as gelatin from polypeptides, proteins, carbohydrates, lipids, nucleic acids, glycoproteins, minerals, lipoproteins, glycolipids, glycosaminoglycans, and proteoglycans. Preferred embodiments of these natural polymers include silk protein, chitosan, collagen, gelatin and elastin.

Figure 4:
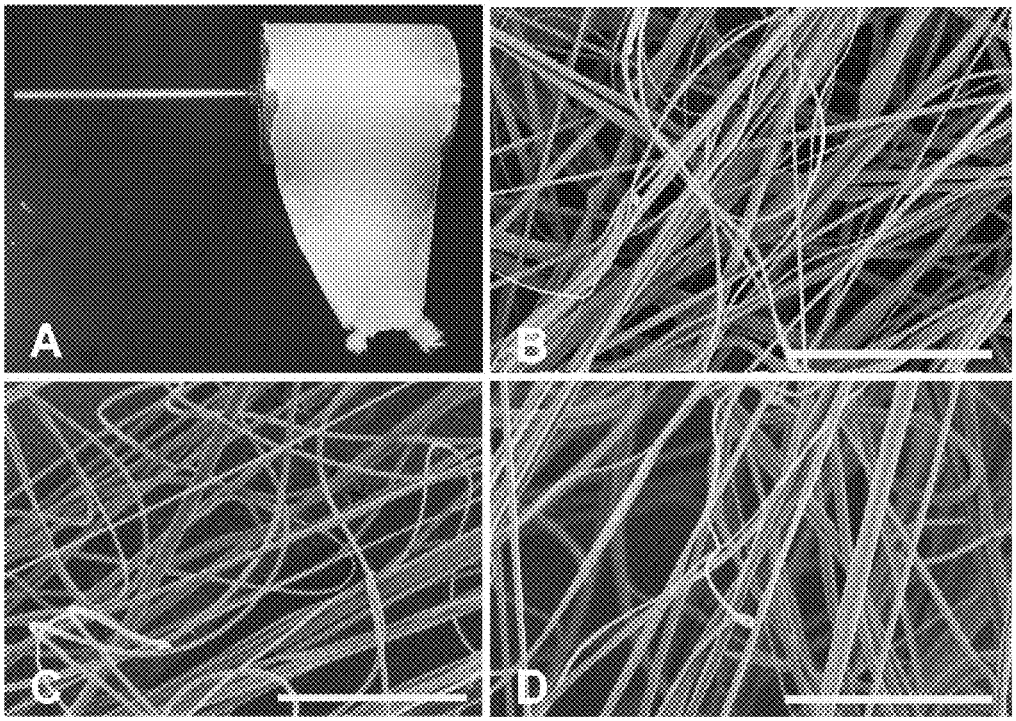
FIG. 4 is a collection of photos of spun polymer fibers collected on a rotating drum, which is a technique also used for collecting electro spun fibers. (A) Photograph of a nonwoven fiber mat deposited on the rotating drum, and SEM pictures of (B) poly(methyl methacrylate) (PMMA), (C) polystyrene (PS), and (D) polylactic acid (PLA fibers). Note the partial alignment of the fibers as a consequence of the target rotation during spinning. Scale bar=50 μm for (B) and 5 μm for (C) and (D).
Figure 5:
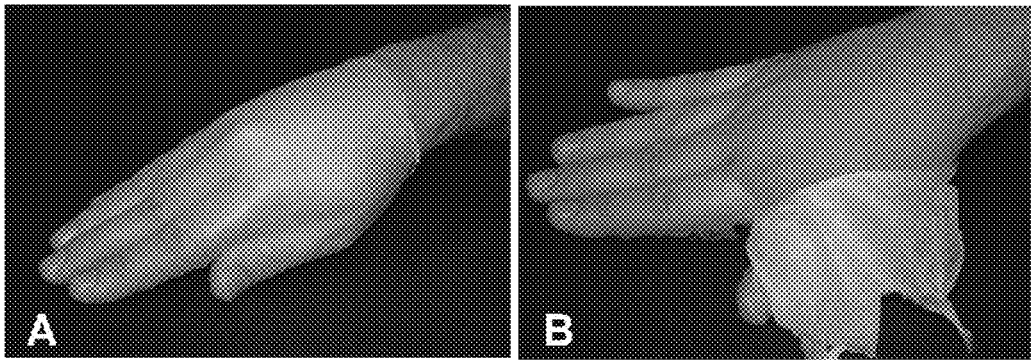
FIG. 5 is a set of photographs showing the feasibility of spraying fibers directly on living tissues. (A) Non-woven PLA fiber mat coating a hand and (B) partial removal of mat showing that a coating had been formed over the skin.

A combination of the aforementioned polymers may be employed. Fibers made from polymer solutions of PMMA, PS, PLA and PLA/PAni using the standard processing conditions mentioned above were readily formed into nonwoven sheets (FIG. 4) by using a rotating collector as shown in FIG. 1. Nonwoven webs were also easily and safely collected on a variety of targets including living tissue (FIG. 5).

Figure 8:
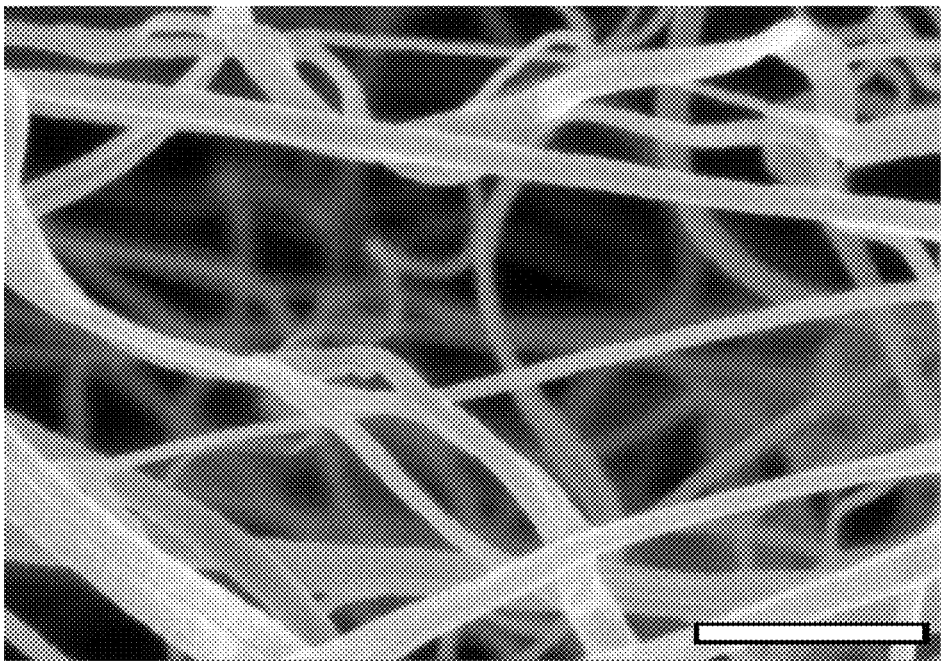
FIG. 8 is a photograph of SEM of PLA nanofibers. Scale bar=500 nm.

The concentration of the polymer solution may range from 1% to 60%, preferably 5% to 20% in solution. Increasing the polymer concentration increased the fiber diameter and conversely, fiber diameters were smallest when using lower polymer concentrations. For example, when a 5% poly(lactic acid) solution in 2,2,2-trifluoroethanol TFE was spun (FIG. 8) using the standard conditions, fibers with diameters as small as 40 nm were produced.

Pharmaceutical agents suitable herein can be organic or inorganic and may be in a solid, semisolid, liquid, or gas phase. Molecules may be present in combinations or mixtures with other molecules, and may be in solution, suspension, or any other form. Examples of classes of molecules that may be used include human or veterinary therapeutics, cosmetics, nutraceuticals, agriculturals such as herbicides, pesticides and fertilizers, vitamins, salts, electrolytes, amino acids, peptides, polypeptides, proteins, carbohydrates, lipids, nucleic acids, glycoproteins, lipoproteins, glycolipids, glycosaminoglycans, proteoglycans, growth factors, hormones, neurotransmitters, pheromones, chalones, prostaglandins, immunoglobulins, monokines and other cytokines, humectants, metals, gases, minerals, plasticizers, ions, electrically and magnetically reactive materials, light sensitive materials, anti-oxidants, molecules that may be metabolized as a source of cellular energy, antigens, and any molecules that can cause a cellular or physiological response. Any combination of molecules can be used, as well as agonists or antagonists of these molecules.

Pharmaceutical agents include any therapeutic molecule including, without limitation, any pharmaceutical substance or drug. Examples of pharmaceuticals include, but are not limited to, anesthetics, hypnotics, sedatives and sleep inducers, antipsychotics, antidepressants, antiallergics, anti-anginals, antiarthritics, antiasthmatics, antidiabetics, antidi-arrheal drugs, anticonvulsants, antigout drugs, antihista-mines, antipruritics, emetics, antiemetics, antispasmodics, appetite suppressants, neuroactive substances, neurotrans-mitter agonists, antagonists, receptor blockers and reuptake modulators, beta-adrenergic blockers, calcium channel blockers, disulfuram and disulfuram-like drugs, muscle relaxants, analgesics, antipyretics, stimulants, anticholinesterase agents, parasympathomimetic agents, hormones, anticoagulants, antithrombotics, thrombolytics, immunoglobulins, immunosuppressants, hormone agonists/antagonists, vitamins, antimicrobial agents, antineoplastics, antacids, digestants, laxatives, cathartics, antiseptics, diuretics, disinfectants, fungicides, ectoparasiticides, antiparasitics, heavy metals, heavy metal antagonists, chelating agents, gases and vapors, alkaloids, salts, ions, autacoids, digitalis, cardiac glycosides, antiarrhythmics, antihypertensives, vasodilators, vasoconstrictors, antimuscarinics, ganglionic stimulating agents, ganglionic blocking agents, neuromuscular blocking agents, adrenergic nerve inhibitors, anti-oxidants, vitamins, cosmetics, anti-inflammatories, wound care products, antithrombogenic agents, antitumoral agents, antiangiogenic agents, anesthetics, antigenic agents, wound healing agents, plant extracts, growth factors, emollients, humectants, rejection/anti-rejection drugs, spermicides, conditioners, antibacterial agents, antifungal agents, antiviral agents, antibiotics, tranquilizers, cholesterol-reducing drugs, antitussives, histamine-blocking drugs, monoamine oxidase inhibitor. All substances listed by the U.S. Pharmacopeia are also included within the substances of the present invention.

Cellulose fibrils may also be added to the polymer solution before spinning to reinforce the fiber. The term "cellulose fibrils" is understood as meaning both nanofibrils and microfibrils, the length of which is less than 100 μm. A preferred length is less than 50 μm. These fibrils generally have a length of greater than 1 μm and preferably ranging from 5 to 40 μm. In addition, the cellulose fibrils can have a diameter ranging, for example, from 1 to 100 nm (0.001 to 0.1/μm); the length/diameter ratio can be equal to or greater than 30. Amorphous cellulose fibers, exhibiting a degree of crystallinity of less than or equal to 50% may also be employed. The fibrils may be obtained by mechanical, sonochemical or chemical extraction from plants or algae or by bacterial fermentation, for example. Furthermore, they can be provided in the form of dry matter or as a dispersion. The cellulose fibrils may be modified, synthetic or obtained commercially i.e. CELLULON®, FIBRILIANCE®.

A direct comparison was made between polymer-solution pairs that could be both electro spun and solution spun (which has fewer relative limitations). The diameters of solution and electro spun fibers made from 10% PMMA, PLA, PS and PLA/PAni blends were similar (Table 3). The diameter of fibers produced by solution spinning of polymer solutions containing PMMA was also comparable to fiber diameters of electro spun PMMA fibers reported elsewhere. Solution spun PMMA fibers had diameters in the range of 1 to 7.8 μm using the standard processing conditions. However, fibers with diameters as small as 160 nm were produced for the same polymer concentration when spun at an air pressure of 517 kPa. Although the standard injection rate used for solution spinning was 20 μL/min, an injection rate of up to 200 μL/min was successfully tested. By comparison, the injection rate typically used for electrospinning is only 4-10 μL/min, roughly more than an order of magnitude lower than that obtained for the solution spinning technique.

Figure 7:
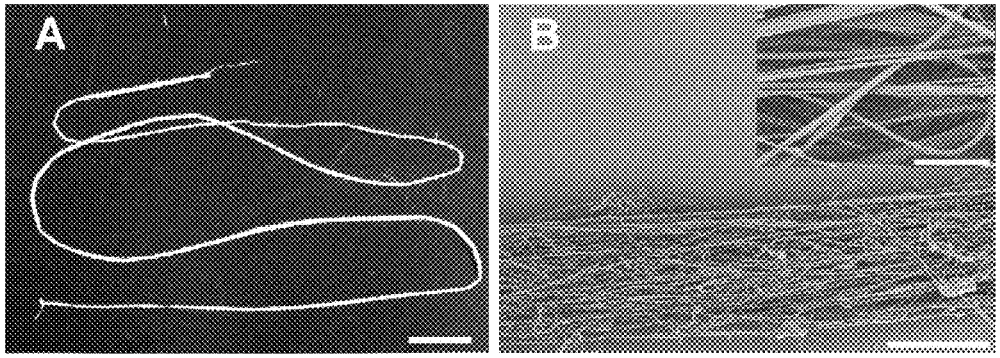
FIG. 7 is a photograph of (A) PMMA yarn several centimeters in length. (B) SEM image of the yarn shows it is made up of long fibers with diameters ranging from 700 nm up to 2 μm. Scale bar=1 cm for A and 200 μm for B (Inset 20 μm).

As with electrospinning, the solution spinning technique generated multiple fiber strands which made it difficult to measure the continuous length of a given fiber. Nevertheless, some fibers isolated from the collector appeared to be several centimeters in length, and it is possible that some fibers could be much longer, depending on how they are collected. For example, continuous yarns several centimeters in length were made by positioning a barrier (e.g., a wire) in front of the nozzle apparatus to capture fibers as they flowed from the nozzle towards the collector (FIG. 7).

Variations in processing parameters affected fiber diameter, morphology, and ease of processing, although, interestingly, the injection rate did not have a pronounced effect on the mean fiber diameter (Table 1). However, injection rates of 60 μL/min and above resulted in fibers that were more consistent in thickness at much higher fiber production rates. Injection rates below 20 μL/min did not adequately supply polymer solution to the nozzle and caused only intermittent flow at the nozzle.

TABLE 1

Effect of processing variables on the diameter of PMMA fibers made by the solution spinning technique. Process variables include injection rate (β), air pressure supplied to outer nozzle (p), working distance (WD, see FIG. 1), inner nozzle protruding distance (D), and polymer concentration (c).

| | | | | | | | |
|---|---|---|---|---|---|---|---|
| β (μL/min) | 5 | 10 | 20 | 40 | 60 | 80 | 100 |
| Fiber Dia. (μm) (std) | 1.22(0.58) | 1.77(1.46) | 2.26(1.24) | 1.39(0.66) | 1.41(0.96) | 1.52(0.94) | 1.01(0.46) |
| p (kPa) | 69.0 | 138 | 276 | 414 | 517 | | |
| Fiber Dia. (μm) (std) | 1.32(0.72) | 2.01(1.13) | 2.26(1.24) | 1.59(0.83) | 0.84(0.43) | | |
| WD (cm) | 7.2 | 12.5 | 17 | 25 | | | |
| Fiber Dia. (μm) (std) | 1.57(0.73) | 2.57(0.87) | 2.76(1.64) | 2.48(1.48) | | | |
| D (mm) | 0 | 1 | 2 | 2.6 | 3 | 3.5 | |
| Fiber Dia. (μm) (std) | 3.46(1.53) | 2.43(1.26) | 3.85(2.40) | 2.98(1.33) | 3.04(1.42) | 3.37(1.52) | |
| c (%) | 5 | 10 | 15 | | | | |
| Fiber Dia. (μm) (std) | 0.87(0.39) | 3.05(1.71) | 5.19 (2.54) | | | | |

The air flow pressure (p) had a relatively small but significant effect on the fiber diameter. When air pressure settings were too low, the fiber strands lost velocity and often did not have the force needed to reach the target. The fiber diameter increased as air pressure increased from 69 to 276 kPa but then decreased with higher pressures. The fibers with the smallest diameters were produced at the highest pressure tested (Table 1). As with electrospinning, there is a balance between gas pressure and polymer injection rate required for successful solution spinning. Elevating the gas pressure may lead to the formation of beaded fibers. However, by maintaining the pressure constant and adjusting the injection rate higher, the gas flow and injection rate once again become balanced and uniform, smooth fibers without beads can be obtained.

The working distance (WD) does not have a significant effect on the fiber diameter (Table 1). However, this parameter is important in fiber morphology, wherein a WD that is too short, will not have adequate opportunity to fully dry before reaching the collector. However, if a film is desired, a short WD can allow for adherence of the newly spun fiber with other fibers and coalesce immediately into a film.

The distance (d) the inner nozzle protruded beyond the plane of the outer nozzle had little effect on the average fiber diameter, but the fiber diameter distribution was broader when the protruding length was either too short or too long, thus a preferred embodiment would be an intermediate length protrusion of 1.0-2.0 mm for the promotion of a uniform fiber diameter. Moreover, processing was affected by d; when d was zero or greater than 3 mm, residue from the polymer solution formed around the nozzle opening or on the inner nozzle itself.

The solution spinning apparatus produces fibers in the same size range as fibers made by electro spinning with greater potential for commercial scale-up. Relative to the electro spinning process, solution spinning can be performed at much higher injection rates (an order of magnitude higher). Furthermore, the solution spinning process does not require high voltage equipment and can be used with a broader array of polymer solutions. It is not limited to solvents with a high dielectric constant, nor does it adversely affect heat or voltage sensitive polymers, such as proteins. The solution spinning process provides great potential for commercial production of nonwoven polymer webs and has potential applications for medical uses such as for tissue scaffolds, the controlled release of drugs and medications, and as wound dressing for skin regeneration. Important applications for micro and nanofibers have also been identified in non-medical products including air filters, protective clothing, sensors, optical electronics, and as a matrix for immobilization of catalysts. Additionally, an embodiment of the invention finds utility in a method for coating different types of materials (ceramics, metals, plastics, rubbers, fibers, woven and non-woven materials as well as biological materials) in order to improve their surface properties or to impart new surface properties such as: decrease permeability of microorganisms, increase surface adhesion, improve barrier properties as well as impart anti-adherent features on the surface of these materials.

Figure 6:
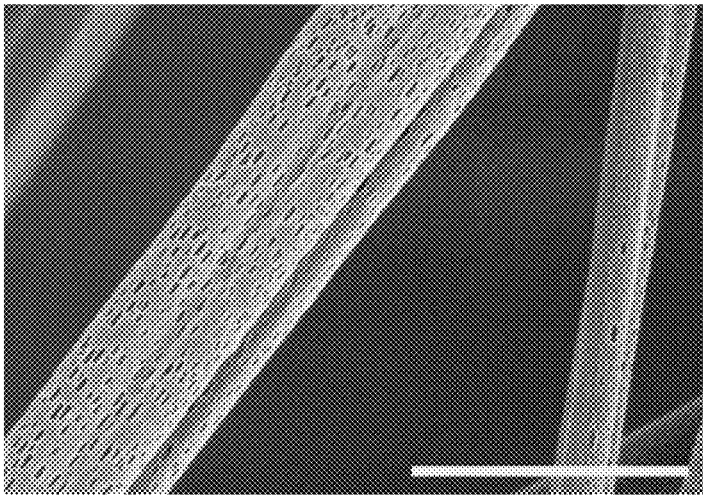
FIG. 6 is a photograph of porous fibers produced by solution spinning. Scale bar=5 μm.

The solution spinning technique is useful in medical applications where nonwoven webs can be applied directly to tissue cultures or to living tissue for a variety of medical procedures without the applying, for example, high electric voltage, as in electrospinning. Moreover, by controlling the relative humidity of the surrounding environment where the fibers are being formed, blowing medium and polymer concentration, it is possible to produce porous fibers with potential application in controlled drug release, for example (FIG. 6).

TABLE 2

Experimental conditions used to produce electrospun and solution spun fibers.

| | Electrospinning | | Solution Spinning | |
|---|---|---|---|---|
| Polymer/solvent | V (kV) | β (μL/min) | p (kPa) | β (μL/min) |
| PS/Toluene | 20 | 6.0 | 276 | 20 |
| PLA/TFE | 11 | 5.0 | 276 | 20 |
| PLA:PAni (96:04 wt %)/HFP | 20 | 6.0 | 276 | 20 |
| PMMA/Chloroform | 11 | 5.0 | 276 | 20 |

TABLE 3

Comparison of fiber diameters for solution and electro spun micro and nanofibers using four different polymer solutions.

| Polymer/solvent | Range of fiber diameter (nm) Solution Spinning | Electrospinning |
|---|---|---|
| PLA/TFE | 80-260 | 90-220 |
| PLA:PAni/HFP | 140-590 | 130-800 |
| PS/Toluene | 220-4,400 | 200-1,800 |
| PMMA/Chloroform | 1,000-7,800 | 1,000-5,000 |

TABLE 4

Average diameter of spun fibers

| Polymer | (Average diameter ± dispersion) (nm) SB spun fibers | Electrospun fibers |
|---|---|---|
| PDLLA | 289 ± 3093 | 159 ± 69 |
| PCL | 317* ± 281 | 98 ± 51 |
| PEO | 267 ± 131 | 278 ± 184 |

*1% of the fibers observed has 3 μm of diameter

Poly(D,L-lactide) PDLLA ($M_n$=75.000 g·mol$^{-1}$) from Biomater (São Carlos, Brazil).

Poly(8-caprolactone) PCL ($M_n$=50.000 g·mol$^{-1}$) were from Perstorp (Warrington, United Kingdom).

Poly(ethylene oxide) PEO ($M_n$=100.000 g·mol$^{-1}$) was obtained from Sigma-Aldrich (USA).

These polymers were spun from the following solutions (Table 5):

TABLE 5

| Polymer | Concentration (wt. %) | Solvent (v/v) |
|---|---|---|
| PDLLA | 6 | chloroform:acetone 3:1 |
| PCL | 6 | dichloromethane |
| PEO | 6 | dichloromethane |

Materials/Methods

Materials

Polymers samples of poly(vinyl alcohol), PVA, (97% hydrolyzed, Mw=5-8×10$^4$ g/mol) poly(methyl methacrylate), PMMA, (Mw=1.2×10$^5$ g/mol), and polystyrene, PS, (Mw=1.9×10$^5$ g/mol) were purchased from Sigma-Aldrich (St. Louis, Mo., USA). Poly(lactic acid), PLA, (Polylactide Resin 4042D, Mw=6.6×10$^4$ g/mol) was acquired from NatureWorks LLC (Minnetonka, Minn., USA). Polyaniline, PAni, was chemically synthesized according to the methodology described in the literature.

The solvents used included 1,1,1,3,3,3-hexafluoro-2-propanol (HFP) and toluene which were purchased from Sigma-Aldrich (St. Louis, Mo., USA) and 2,2,2-trifluoroethanol (TFE) which was purchased from Alfa Aesar (Ward Hill, Mass., USA).

Methods

Solution Spinning Apparatus: The air spinning apparatus used in this study consisted of a nozzle through which a polymer solution was injected into a stream of accelerated air. The setup consisted of a source of compressed gas, such as nitrogen, argon and air, equipped with a pressure regulator, a 5-mL hypodermic syringe, a syringe pump (KD Scientific, USA) to control the injection rate (β) of the polymer solutions, a spraying apparatus that consisted of concentric nozzles, and a collector with a controllable rotation speed (FIG. 1). The collector was positioned at a fixed working distance from the nozzle. The spraying apparatus consisted of an inner and a concentric outer nozzle (FIG. 2). The polymer solution was pumped through the inner nozzle and high velocity gas (pressurized) passed through the concentric outer nozzle (FIG. 2).

Experimental Design: A series of experiments was performed by varying processing parameters using a polymer solution consisting of 10% PMMA in chloroform. Processing variables were tested to determine their effect on fiber thickness and morphology. Standard process conditions included an injection rate (β) of 20 μL/min, gas (nitrogen) pressure (p) of 276 kPa, working distance of 20 cm, a distance (d) of 2 mm that the inner nozzle protruded beyond the outer nozzle, and a polymer concentration (c) of 10%. The effect of individual processing variables was studied using the standard conditions and changing only a single variable at a time. The level of each variable tested is indicated in Table 1. Fiber diameters were measured for a minimum of fifty fibers for each variable tested. Fiber morphology was determined by SEM. Solutions (10%) of PLA and PS in TFE and toluene, respectively, were also prepared to demonstrate the solution spinning technique with a variety of polymer solutions.

Electrospinning: An electrospinning apparatus was set-up and conditions were optimized as previously described. Electrospinning and solution spinning techniques were compared by producing fibers from both techniques using the same polymer solutions. The experimental conditions used for electrospinning each polymer/solvent system are listed in Table 2. In each experiment, polymer concentration (10%, w.v), working distance (20 cm), and rotation speed of the collector (800 rpm) were kept constant.

Solution Spinning Imaging: Strands of polymer solution that jettisoned from the inner nozzle were photographed with a rolling shutter camera (Model SI1280M-CL, Silicon Imaging, Inc., Costa Mesa, Calif., USA) at 450 frames per second. The camera was mounted on a stereomicroscope (Model MZ 16 F, Leica Microsystems Ltd, Heerbrugg, Switzerland) and focused on the inner nozzle tip. A white background and a fiber optic light source (Model MC500, Schott Instruments GmbH, Mainz, Germany) provided high contrast imaging. Polyaniline (PAni) was blended with PLA (4:96 wt %) in HFP to further enhance image contrast by making it darker and more opaque.

Scanning Electron Microscopy (SEM) characterization: Samples were spun onto a rotating collector and collected for SEM analysis. SEM samples were coated by gold sputtering for 45 s and analyzed for fiber morphology using a Hitachi Scanning Electron Microscope (Model 54700, Hitachi High-Technologies, Japan) operated at a voltage of 2 kV. Fiber thickness was measured on SEM images using specialized software (MeasurelT, version 5.0, Olymus Soft Imaging Solutions, GmbH).

What is claimed:

1. A non-electrostatic field method of producing micro and nanofibers from a polymer solution consisting essentially of:

A compound nozzle comprised of at least one internal concentric nozzle component, A polymer solution prepared from at least one solvent or mixture of solvents;

Delivering the polymer solution through at least one internal concentric nozzle component, Delivering a pressurized gas through an external nozzle component, and collecting the produced fibers on a target.

2. A method to produce micro and nanofibers according to claim 1 wherein the polymers are selected from the group consisting of poly(lactic acid), poly(methyl methacrylate), poly(vinyl chloride), poly(vinyl alcohol), polystyrene, polyaniline, silk protein, gelatin, collagen, chitosan, poly(ethylene oxide), polycaprolactones, polyamides, polyacrylonitrile, poly(ethylene terephthalate), poly(vinyl pyrrolidone), polyurethanes, natural and synthetic rubbers, or their compounds derivatives thereof.

3. A method to produce micro and nanofibers according to claim 2, wherein the polymer solution is a blend of polymers.

4. A method to produce micro and nanofibers according to claim 1, wherein the fiber morphology is selected from the group consisting of a solid core, porous core, core and sheath, hollow and mixtures thereof.

5. A method to produce mats of micro and nanofibers according to claim 1, wherein the micro and nanofibers are solid core, porous core, hollow, porous hollow and mixtures thereof.

6. A method to produce mats of micro and nanofibers according to claim 1, wherein the polymer concentration is 0.1% to 70% by weight of the solvent.

7. A method to produce mats of micro and nanofibers according to claim 1 wherein the solvents are selected from the group consisting of 1,1,1,3,3,3-hexafluor-2-propanol (HFP), toluene, chloroform, 2,2,2-trifluorethanol (TFE), acetone, water, acetic acid, formic acid, alcohols, dimethylformamide (DMF), tetrahydrofurane (THF), hexafluoroacetone, isopropyl alcohol, dimethyl formamide (DMF), dimethyl acetamide (DMAc), methyl ethyl ketone (MEK), dimethyl sulfoxide (DMSO), cyclohexane, among others.

8. A method to produce mats of micro and nanofibers according to claim 1 wherein the polymer solutions contain organic and inorganic particles selected from the group consisting of carbon nanofibers, cellulose nanofibers, $ZrCO_2$, ZnO, CuO, $NiO_2$, and $Mn_3O_4$.

9. A method to produce mats of micro and nanofibers according to claim 1 wherein the gas is selected from the group consisting of air, nitrogen, argon, oxygen, $CO_2$, butane and mixtures thereof.

10. A method to produce mats of micro and nanofibers according to claim 1 wherein the polymer solution is ejected by the compressed gas whose pressure ranges from 1 to 1000 kPa and polymer feed rate ranges from 1 to 1000 μL/min.

* * * * *